US005531391A

United States Patent [19]

Yamamoto

[11] Patent Number: 5,531,391

[45] Date of Patent: Jul. 2, 1996

[54] METHOD AND APPARATUS FOR AUTOMATICALLY INSPECTING AND WINDING YARN, STOPPING AND REMOVING DEFECTIVE YARN AND RECONNECTING AND RESTARTING WINDING AFTER DEFECTIVE YARN IS REMOVED

[75] Inventor: Atsushi Yamamoto, Ohtsu, Japan

[73] Assignee: Murata Kikai Kabushiki Kaisha, Kyoto, Japan

[21] Appl. No.: 234,852

[22] Filed: Apr. 28, 1994

[30] Foreign Application Priority Data

May 12, 1993 [JP] Japan ..... 5-110629

[51] Int. Cl.[6] ..... B65H 69/04; B65H 54/02

[52] U.S. Cl. ..... 242/35.60 R; 57/22; 57/261; 57/279; 242/36

[58] Field of Search ..... 242/36, 35.5 R, 242/35.6 R; 57/261, 262, 263, 22, 279, 280

[56] References Cited

U.S. PATENT DOCUMENTS

| | | | |
|---|---|---|---|
| 4,322,943 | 4/1982 | Rohner et al. | 57/261 |
| 4,513,921 | 4/1985 | Imoda et al. | 242/36 |
| 4,854,515 | 8/1989 | Tone | 242/35.6 R |
| 4,911,372 | 3/1990 | Uchida et al. | 57/22 X |
| 5,022,596 | 6/1991 | Wey et al. | 242/36 |
| 5,065,949 | 11/1991 | Tone | 242/35.5 R |
| 5,115,629 | 5/1992 | Zumfeld | 57/261 |
| 5,127,595 | 7/1992 | Tone | 242/35.6 R |
| 5,188,304 | 2/1993 | Colli et al. | 242/35.6 R |
| 5,284,010 | 2/1994 | Dammann | 242/35.5 R |
| 5,293,738 | 3/1994 | Ferro et al. | 57/261 |

*Primary Examiner*—Daniel P. Stodola
*Assistant Examiner*—William Stryjewski
*Attorney, Agent, or Firm*—Armstrong, Westerman, Hattori, McLeland & Naughton

[57] ABSTRACT

An automatic yarn winder wherein a yarn is taken up from a yarn supply bobbin and wound in a package and defects of the yarn is detected and the detected defect in the yarn is cut out and removed. The trailing cut end of the wound yarn and the leading end of the cut yarn are joined comprising yarn take-up device, stopping device for stopping yarn take-up when the number of detections becomes higher than a pre-fixed number for a fixed length of yarn being wound and taking up device for taking up the yarn from the yarn supply bobbin for a predetermined time after such stopping and joining the leading end of the remaining yarn on the yarn supply bobbin to the trailing end of the yarn on its package and re-starting taking up.

13 Claims, 4 Drawing Sheets

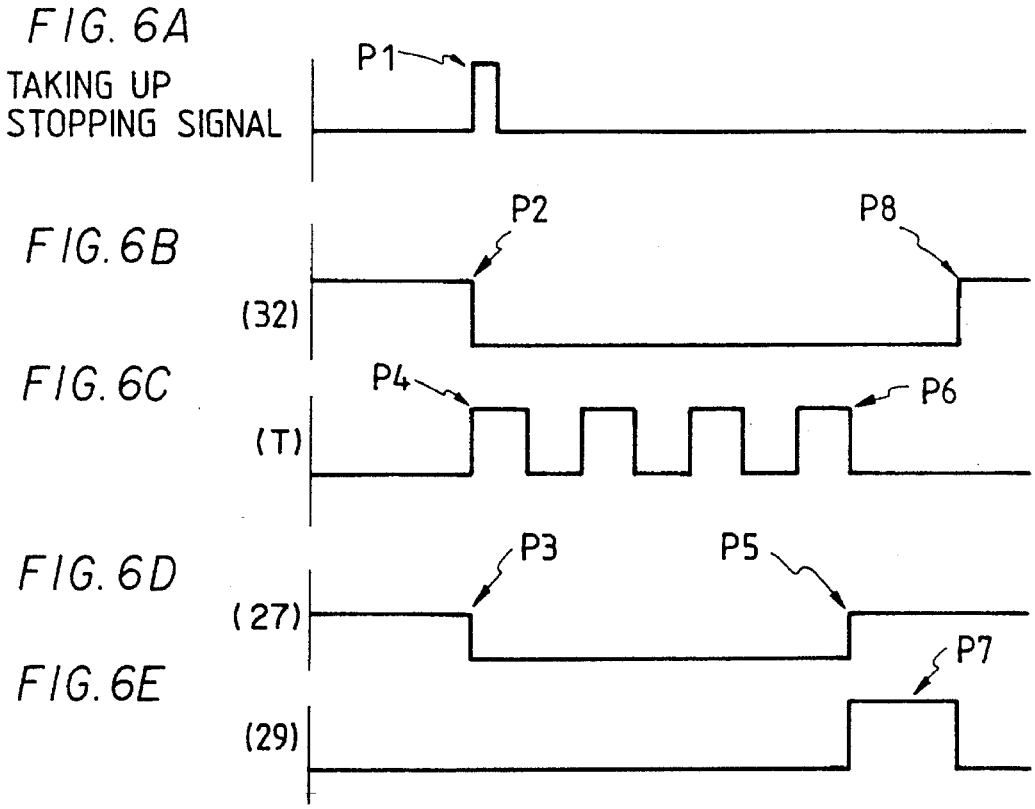
FIG. 7
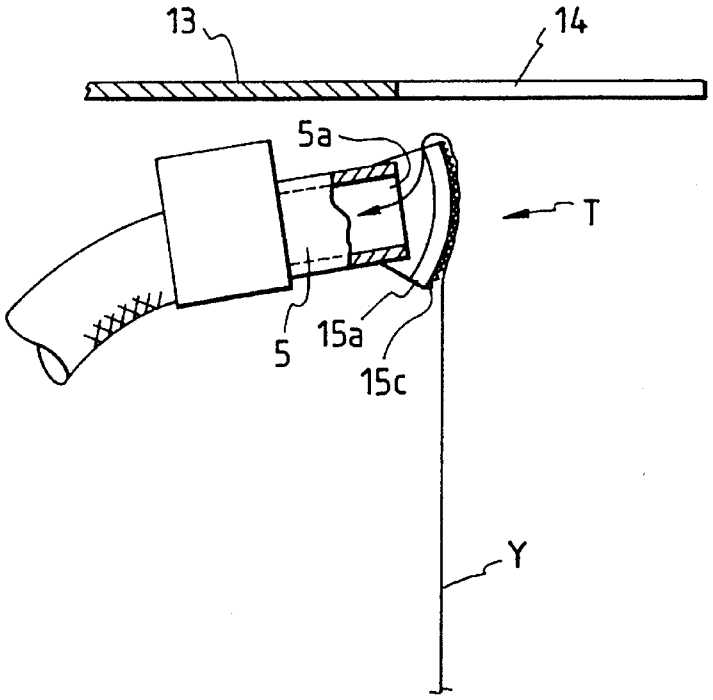

METHOD AND APPARATUS FOR AUTOMATICALLY INSPECTING AND WINDING YARN, STOPPING AND REMOVING DEFECTIVE YARN AND RECONNECTING AND RESTARTING WINDING AFTER DEFECTIVE YARN IS REMOVED

BACKGROUND OF THE INVENTION

Field of the Invention

This invention relates to an automatic winder for winding up a yarn of a fixed length on a take-up package while keeping the quality and, particularly, to an automatic winder which can restore itself without manual operation even when a defect of a yarn occurs frequently.

PRIOR ART

An automatic winder is an apparatus having a large number of take-up units each of which takes up a yarn from a yarn supply bobbin, supplied to such bobbin from a spinning frame, onto a package joining the yarn so that the yarn, on the take-up package, has a predetermined length. If the yarn supply bobbin becomes empty, it is automatically replaced with a new yarn supply bobbin, and a yarn supplied from the new yarn, supply bobbin can be connected to the yarn already taken up on the take-up package, to continue taking up. Meanwhile, when the yarn is broken during taking up, or when a defect of the yarn is detected and the yarn, is cut, the thus broken yarn or a yarn of a succeeding conforming article, is connected to the yarn on the take-up package side to continue taking up.

Detection and cutting of a defect of a yarn are performed by a slub catcher. The slub catcher is located on a passage of the yarn and always checks the thickness occur, of the yarn. When abnormality in thickness that is, the yarn is thicker or thinner than a certain ratio compared with the original thickness, or abnormality that some variation in thickness continues over a predetermined length, is detected, the yarn is cut compulsorily.

After such, compulsory cutting of the yarn, joining of the yarn is performed by means of a yarn joining apparatus. Because the opposite ends of the yarn, thus cut, are lost by some lengths, upon joining of the yarn, the defective portion is roughly removed at the front and the rear of the defective portion. Taking up is then continued. A take-up package can be put into a condition, free from any defective portion, in this manner.

The series of operations of the detecting operation of a defect, the cutting operation and the yarn joining operation described above is called yarn joining cycle. When such yarn joining cycle occurs singly, it is possible to remove the defective portion and continue taking up as described above. However, when such yarn joining cycle occurs frequently, it is considered that the yarn supply bobbin, or some other element, has some trouble, and accordingly, correction of the trouble by an operator is waited before continuing taking up or such yarn. In particular, when the number of times of a yarn joining cycle for a fixed length is higher than a predetermined number, the automatic winder sounds an alarm and stops the take-up unit. The take-up unit thus remains stopped and waits for an operator. In other words, the stopping condition continues unless taking up is re-started by way of operation of a switch, or the like, after an operator has corrected the trouble.

When the alarm sounds, although the operator may sometimes discover the trouble and repair the machine, frequent occurrence of stopping of the yarn joining cycle is eliminated, in most cases, only by replacing the yarn supply bobbin. In other words, taking up is re-started only by discarding the yarn supply bobbin having remaining yarn mounting a new yarn supply bobbin and re-starting winding operation.

However, in a factory with equipment which includes an automatic winder, normally, a large number of automatic winders are juxtaposed in a wide site, and each automatic winder is composed of a large number of take-up units. Besides, operation of such automatic winder is almost automated, and the factory is almost in a man-free condition. In such factory, a operator watches a monitor of a concentrated control apparatus in a control room, or a like place, and perceives observes the occurrence of such an alarm, as described above. Accordingly, for a time after a take-up unit stops until processing can be retarted, the time for the concentrated control apparatus to collect information of the take-up unit, the time for the operator to recognize the display of the monitor and the time for the operator to go to the spot are involved. These times determine the stopping time of the spindle.

Meanwhile, because only a simple processing as described above is required in most cases, it is cumbersome for the operator to go to the trouble of going to the spot in the wide factory.

SUMMARY OF THE INVENTION

It is an object of the present invention to provide an automatic winder which can determine and correct the subject described above trouble causing stopping and restore itself without manual operation even when a defect of a yarn appears frequently.

In order to attain the object described above, an automatic winder wherein a yarn is taken up from a yarn supply bobbin onto a package and a defect of the yarn is detected and then the yarn is cut and joined comprises, taking up stopping means for stopping taking up when the number of times of detection of a defect becomes higher than a fixed number for a fixed length, and taking up re-starting means for releasing and abandoning the yarn of the yarn supply bobbin for a predetermined time after such stopping, joining the remaining yarn on the yarn supply bobbin and re-starting taking up.

While the cause by which a defect of a yarn occurs frequently may be a trouble of a spinning frame, a mechanical trouble or a trouble of a raw material at a preceding stage, or some other cause, it is experientially known that the cause can be eliminated if a yarn supply bobbin is replaced as described above. However, all of remaining yarns abandoned may not be non-conforming articles. Actually, it has been found out that, when it was attempted to artificially release, upon development of the alarm described above, a remaining yarn on a yarn supply bobbin over some length and then perform yarn joining and re-start taking up, it was, in most cases, possible to continue taking up without any trouble. In other words, if a yarn of some length is abandoned from a portion at which a yarn break occurs frequently, then it seldom occurs that a yarn break thereafter takes place frequently. If such processing can be performed without manual operation, there is no necessity for an operator to go to the site any more.

In particular, with the construction described above, when the number of times of detection of a defect becomes higher than the predetermined number for the fixed length, taking up is stopped, and the yarn of the yarn supply bobbin is released and abandoned for the predetermined time. Here, the predetermined time is a time for which a yarn of such a length which prevents re-occurrence of a yarn break is released. Thereafter, the remaining yarn on the yarn supply bobbin and the yarn on the take-up package side are joined with each other, and taking up is re-started.

It is to be noted that, when a yarn break occurs again within the predetermined time after taking up is re-started, an alarm is developed and the take-up unit is stopped to wait for an operator.

BRIEF DESCRIPTION OF THE DRAWINGS

FIG. 6 is a time chart of a method of the present invention.

FIG. 7 is a side elevational view, partly in section, illustrating a condition wherein the cover is closed when a yarn is sucked by the yarn trap.

DETAILED DESCRIPTION OF PREFERRED EMBODIMENT

Figure 1:
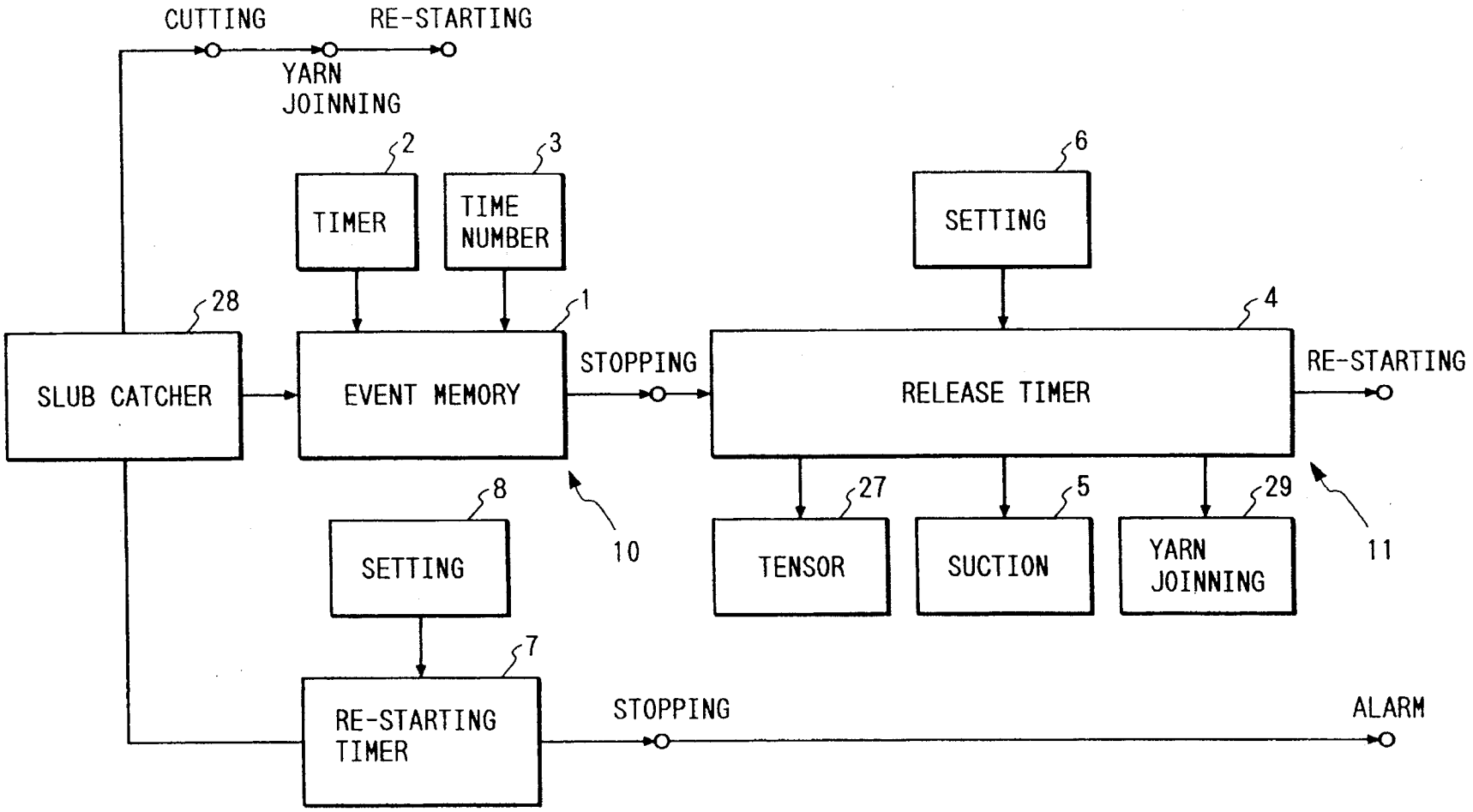
FIG. 1 is a block diagram showing an embodiment of the present invention.

In the following, an embodiment of the present invention will be described in detail with reference to the accompanying drawings.

First, an automatic winder will be described. The automatic winder includes a large number of take-up units 21 shown in FIGS. 2 and 3 arranged in a juxtaposed relationship with each other. Each of the take-up units 21 can individually perform such operations as yarn releasing, feeding, taking up, yarn joining and removal of a defective yarn. The take-up unit 21 forms a yarn passage Y along which a yarn is fed from a yarn supply bobbin 24, which is placed on and transported by a peg 23 on a bobbin supplying apparatus 22, to a take-up package 25 mounted at an upper portion of the take-up unit 21, and is equipped intermediately of the yarn passage Y with several members having various functions. The names and functions of the members are a tensor 27 for applying suitable tension to a yarn released from the yarn supply bobbin 24 and fed by way of a guide 26, a slub catcher 28 which detects an irregular portion of a yarn and cuts the yarn and also serves for detection of travel of a yarn, a yarn joining apparatus 29 for joining yarns on the yarn supply bobbin side and the take-up package sider a first suction arm 30 for guiding a yarn on the yarn supply side to the yarn joining apparatus 29 (in FIGS. 2 and 3, it is also shown that the suction arm 30 has moved to the yarn supply bobbin side), a second suction arm 31 for guiding a yarn on the take-up package side to the yarn joining apparatus 29, and a winding drum 32 for rotating the take-up package. The take-up package 25 is removably mounted on the winding drum 32. Meanwhile, a suction pipe 33 is connected to the take-up unit 21 so that air flows for sucking a yarn can be supplied to the suction arms 30 and 31. The take-up unit 21 is mounted uprightly on the automatic winder with a lower end portion thereof supported on a support pipe 34 so that it can be tilted around the support pipe 34.

Figure 4:
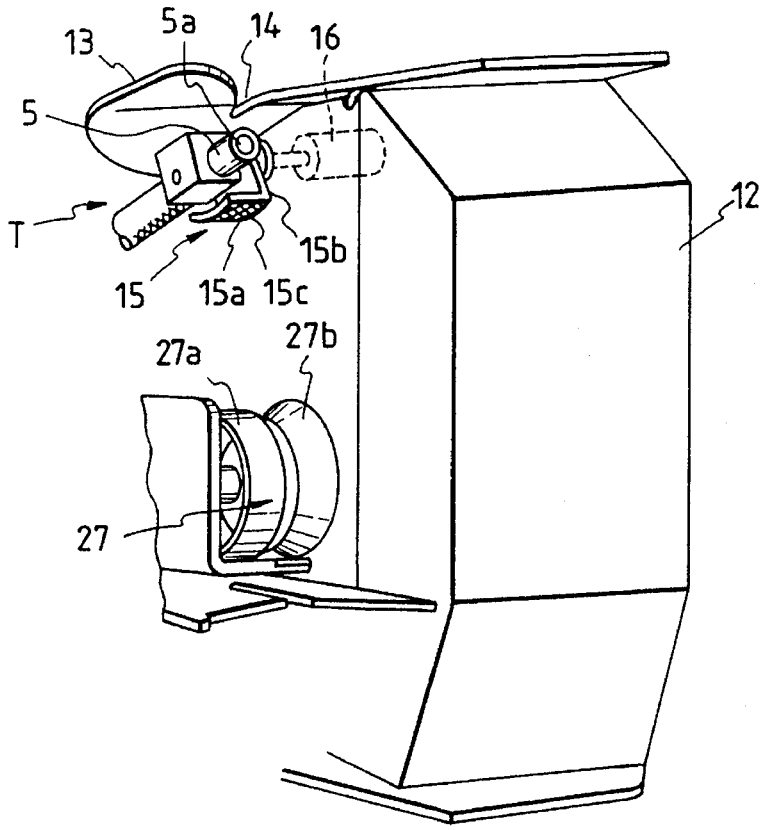
FIG. 4 is a perspective view showing the arrangement of a yarn trap and a tensor.
Figure 5:
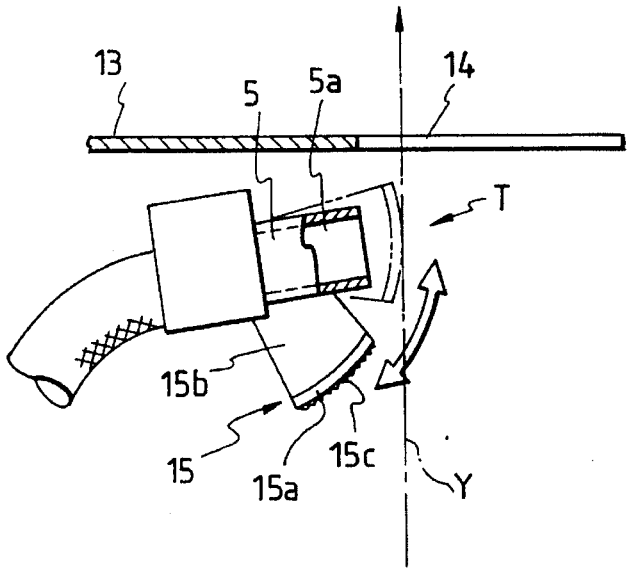
FIG. 5 is a side elevational view, partly in section, illustrating opening and closing conditions of a cover of the yarn trap.

Referring to FIGS. 4 and 5, above the tensor 27 described above, a yarn trap T which serves as sucking means according to the present embodiment is provided. The yarn trap T is constituted from an air sucking pipe 5 for removing fly waste such as waste thread or waste fiber included in a travelling yarn Y and sucking and holding an end of a yarn broken during taking up, a shutter 15 for opening and closing an inlet opening **5*a* of the air sucking pipe 5, and a high friction face 15*c* formed on the surface of the shutter 15** by knurling.

Figure 2:
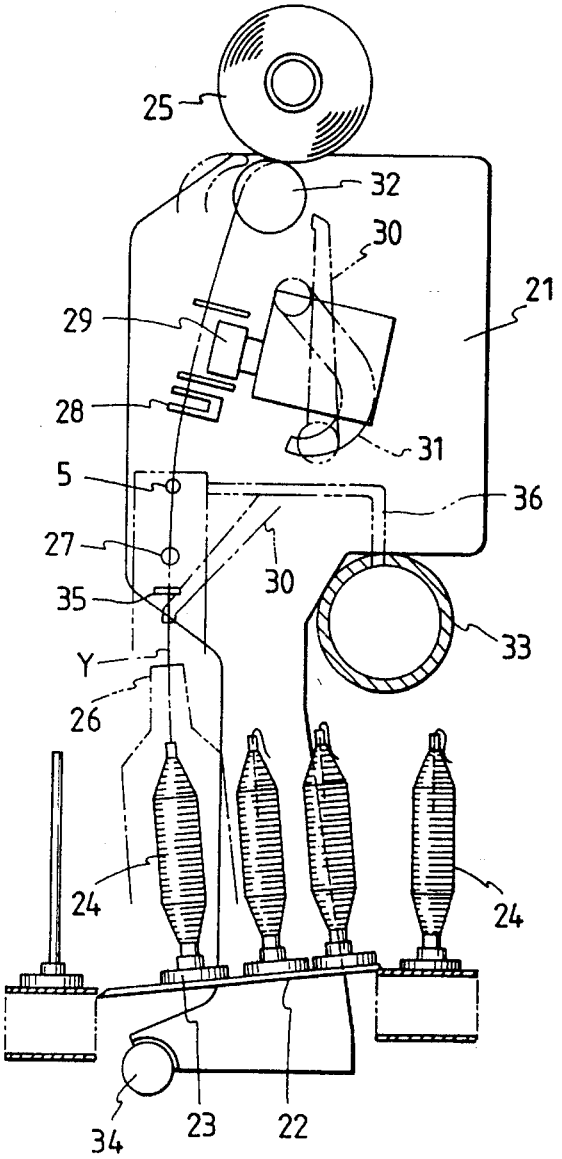
FIG. 2 is a side elevational view of a take-up unit.
Figure 3:
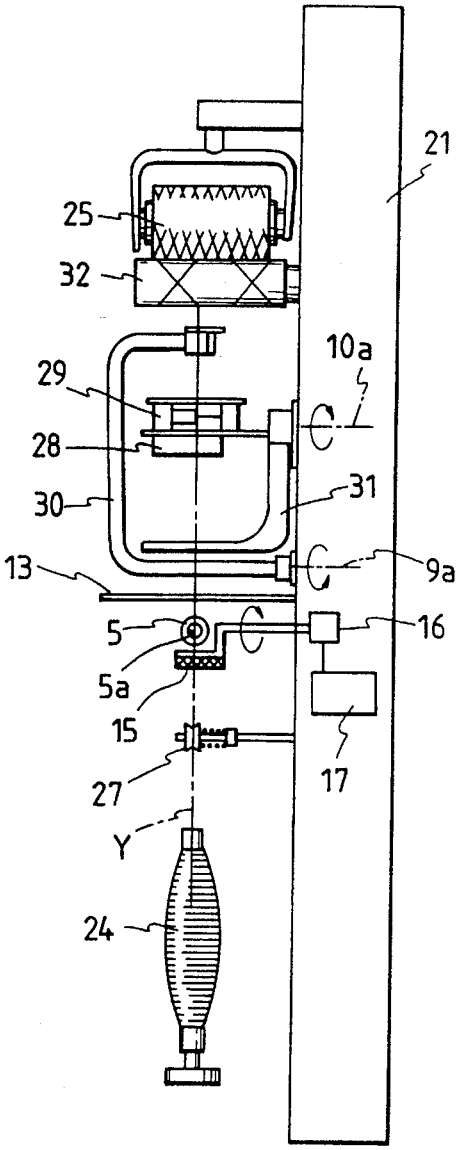
FIG. 3 is a front elevational view of the take-up unit.

The air sucking pipe 5 described above is provided at a position below a yarn guide plate 13 on the yarn passage of the yarn Y to be taken up from the yarn supply bobbin 24 onto the take-up package 25 as shown in FIG. 2 and is connected to an air sucking blower (not shown). A V-shaped guide groove 14, FIG. 4, is formed on the yarn guide plate 13, and the yarn Y travels in the interior of the guide groove 14. The inlet opening **5*a* of the air sucking pipe 5 is opened and closed freely by the shutter 15**.

The shutter 15 is constituted from a lid plate **15*a* curved arcuately for substantially opening and closing the inlet opening 5*a*, the high friction face 15*c* formed on the surface of the lid plate 15*a* by knurling, and a bracket 15*b* connected to an end face of the lid plate 15*a*. In particular, the high friction face 15*c* described above is constituted from a plurality of grooves formed on the surface of the lid plate 15*a* in such a manner as to cross obliquely each other. Meanwhile, the bracket 15*b* is pivoted by energization of a rotary solenoid 16 provided in a side frame 12, and by such pivotal motion, the lid plate 15*a* opens or closes the inlet opening 5*a* of the air sucking pipe 5 as shown by broken and solid lines in FIG. 5. Here, the rotary solenoid 16 described above has a spring member provided in the inside thereof so that, when it is not energized, the lid plate 15*a* returns to its opening position. It is to be noted that an air actuator or some other member may be used in place of the rotary solenoid 16**.

Referring to FIG. 2, reference numeral 35 denotes a cutter. The cutter 35 cuts, when the suction arm 30 is pivoted to suck and grasp the yarn extending between the air sucking pipe 5 of the yarn trap T FIGS. 4 and 5 and the yarn supply bobbin 24, the yarn between the suction arm 30 and the yarn trap T to allow the suction arm 30 to suck an end of the yarn on the yarn supply bobbin side. The cut end of the yarn between the cutter 35 and the yarn trap T is sucked into and abandoned by the yarn trap T.

FIG. 1 shows a block diagram according to the present invention which is part of a control block of an automatic winder. A slub catcher 28, a tensor 27 and a yarn joining apparatus 29 are such as those described above with reference to FIG. 2.

Referring to FIG. 1, an event memory 1 stores occurrence of a yarn break by the slub catcher 28 together with a time indicated by a timer 2, and when the stored time becomes a fixed time with respect to the time indicated by the timer 2, the storage is erased. On the other hand, when the number of events stored exceeds a number of times set in a time number setting section 3, a signal for stopping taking up is generated. In other words, the event memory 1 constitutes taking up stopping means 10 for stopping taking up when the number of times of detection of a defect becomes greater than a predetermined number for a fixed length.

A release timer 4 performs opening and closing of the tensor 27, control of the sucking section 5 and instruction of yarn joining to the yarn joining apparatus 29. A release time setting section 6 sets an operation time of the release timer 4. Here, the sucking section 5 signifies a yarn trap T which sucks and discharges a yarn by means of a suction air flow, and is constituted from a member of the sucking section, a pipe (36 in FIG. 2), the suction pipe 33 and some other members. When the sucking section 5 is rendered operative in an open condition of the tensor 27, the yarn supply bobbin can be released. The release timer 4 constitutes taking up re-starting means 11 for joining the remaining yarn of the yarn supply bobbin and re-starting taking up after the yarn of the yarn supply bobbin is released and abandoned for a predetermined time after stopping.

A re-starting timer 7 is started upon re-starting after operation of the release timer 4 and performs compulsory stopping if a yarn break is detected by the slub catcher 28 within a time set in a re-starting time setting section 8.

Subsequently, operation of the embodiment will be described.

The yarn delivered from the yarn supply bobbin 24 is guided along the yarn passage Y by the guide 26 and acted upon by suitable tension by the tensor 27, and then, an irregular portion of the yarn is detected by the slub catcher 28, whereafter the yarn is taken up onto the take-up package 25 by the winding drum 32. If the yarn supply bobbin 24 becomes empty, then the bobbin supplying apparatus 22 replaces the yarn supply bobbin 24 with another new yarn supply bobbin 24. A yarn supplied from the new yarn supply bobbin 24 is sucked at a leading end thereof by the suction arm 30 in the proximity of the guide 26, and is guided to the yarn joining apparatus 29 by a swinging up movement of the suction arm 30. Meanwhile, the yarn taken up already on the take-up package is sucked at a trailing end thereof by the suction arm 31 thus swung up, and is guided into the yarn joining apparatus 29 by a swinging down movement of the suction arm 31. In the yarn joining apparatus 29, the upper and lower yarns are twisted together or joined with each other so that they are connected integrally with each other. Thereafter, taking up can be continued. If the take-up package 25 becomes full, travel of the yarn is stopped and a new take-up package 25 is mounted.

As shown in FIG. 1, when an irregular portion of the yarn is detected by the slub catcher 28, cutting, yarn joining and re-starting of taking up are performed. Simultaneously, occurrence of the yarn break and the time of the occurrence are stored into the event memory 1. The stored contents are erased after a predetermined time elapses. Accordingly, only an event or events within the last predetermined time remain in the event memory 1. When the number of events exceeds the number of times set in the time number setting section 3, a signal to stop taking up (P1), FIG. 6, is generated. The take-up unit 21 stops its taking up (P2).

The release timer 4 opens the tensor 27. After the tensor 27 is opened (P3), the yarn of the yarn supply bobbin 24 is free. When the yarn trap T is released (P4) and the sucking section 5 sucks the yarn, the yarn of the yarn supply bobbin 24 is released. The tensor 27 is closed (P5) when the predetermined time set in the release time setting section 6, for example, 10 seconds, elapses. In the meantime, the yarn of the predetermined length released from the yarn supply bobbin 24 is sucked into the sucking section 5. Further, the cover 15 of the yarn trap T is closed (P6).

Subsequently, the yarn joining apparatus 29 performs yarn joining (P7). Thereupon, the yarn on the sucking section 5 side is cut by the cutter 35 described above and is discharged by way of the suction pipe 33. Then, taking up is re-started (P8) and the re-starting timer 7 is started. Here, in almost all cases, taking up can be continued without suffering from a yarn break.

It is to be noted that, while the yarn is sucked into the discharged by the yarn trap T, the cover 15*a* of the yarn trap T is controlled so that opening and closing thereof are repeated as shown in FIG. 6.

When it sometimes occurs that the yarn to be sucked is caught by an end face of the suction pipe 5 at the entrance of the suction pipe so that suction of the yarn is obstructed, the cover 15 is closed to its position of FIG. 7 so that the yarn passage is varied by the cover 15, and consequently, such catching of the yarn by the pipe 5 is eliminated.

When a yarn break occurs again immediately after taking up is re-started, it is considered that this may possibly be caused by a trouble of the machine or the like. If the slub catcher 28 operates before the re-starting timer 7 exceeds the time set in the re-starting time setting section 8, the take-up unit 21 develops an alarm and stops itself to wait for an operator.

Subsequently, another embodiment will be described. While, in the embodiment described above, a time at which a yarn break occurs is stored into the event memory and the storage is erased after the fixed time, occurrences of a yarn break may be counted within a predetermined taken up length of a yarn. In this instance, since a taken up length of the yarn is detected from rotation of the winding drum 32, the event memory stores such length upon occurrence of a yarn break and erases the storage if the fixed length is thereafter taken up. Further, erasure of the event memory 1 is performed also when the yarn supply bobbin 24 becomes empty and is replaced. In the embodiment mentioned above, the case in which the sucking and discharging action for a yarn is performed by means of the yarn trap T is disclosed. However, it is to be noted that other suction device can be additionally provided, or the first suction arm 30 can suck and discharge a yarn as in the case illustrated in the above embodiment.

The present invention exhibits such superior effects as described below.

(1) The possibility that operation of a take-up unit is recovered without waiting processing of an operator is high, and the working efficiency of the take-up unit can be improved.

(2) Since re-stopping does not occur in most cases after automatic re-starting, the frequency in which an operator goes to the site is reduced. The frequency in which the operator goes to the site for processing every time is reduced, and the labor is reduced.

(3) Since a yarn supply bobbin is not abandoned but a remaining yarn is used, the yarn finely spun is taken up without waste. In other words, the yield in fine spinning is improved.

What is claimed is:

1. A method for automatically taking up yarn from a yarn supply bobbin onto a package, detecting defect in the yarn being taken up, cutting said yarn when defect is detected and removing a length of said yarn with said detected defect, joining the leading end of said yarn being supplied from said supply bobbin to the trailing end of the yarn on said package and automatically restarting taking up the yarn, wherein, when the frequency of detection of a defect in said yarn, cutting, joining and automatic restarting becomes higher than a pre-set frequency, taking up is stopped and a pre-set length of the yarn of the yarn supply bobbin is removed and, the leading end of the yarn on the yarn supply bobbin is joined to the trailing end of the yarn on the package and taking up is restarted.

2. A method as claimed in claim 1, wherein the detection of a defect is performed by a slub catcher on a yarn passage between said yarn supply bobbin and said package, and cutting of the yarn is performed automatically when a defect is detected.

3. A method as claimed in claim 1, wherein the detection of a defect and the yarn of the supply bobbin removal is based on the number of yarn breaks.

4. A method as claimed in claim 1, wherein taking up is stopped and the yarn of the supply bobbin is removed when the number of detections of defects reaches a number of times set for a unit length of the yarn.

5. A method as claimed in claim 1, wherein taking up is stopped and the yarn of the supply bobbin is removed when the number of detections of defects reaches a number of times set for a unit of time.

6. A method as claimed in claim 1, wherein removal of the yarn of the yarn supply bobbin is performed by a yarn sucking section provided on a yarn passage between said supply bobbin and said package.

7. A method as claimed in claim 6, wherein removal of the yarn by said yarn sucking section is performed intermittently.

8. A method as claimed in claim 1, wherein, when a yarn break occurs within a predetermined time after taking-up is restarted, taking up is stopped and an alarm is actuated.

9. An automatic winder for automatically rewinding yarn from a yarn supply bobbin onto a package, comprising take-up means for taking up a yarn form a yarn supply bobbin onto a package, defect detecting means for detecting defect in the yarn supplied from said yarn supply bobbin and cutting said yarn with said defect, yarn removing means for removing said preset length of said yarn from said yarn supply bobbin, joining means for joining a leading end of yarn being supplied from said yarn supply bobbin after said pre-set length of yarn is removed, and controlling means for controlling operation of said take-up means, said yarn joining means and said yarn removing means in response to detection by said detecting means.

10. An automatic winder as claimed in claim 9, wherein said controlling means includes means for stopping said take-up means when the number of times of detection of a defect within a predetermined length of the yarn by said detecting means exceeds a preset number of times, and removing said preset length of yarn from the yarn supply bobbin for a predetermined time, thereafter joining the leading end of the yarn from said yarn supply bobbin to the trailing end of the yarn fed to the take-up package and re-starting operation of said take-up means.

11. An apparatus as claimed in claim 9, wherein said removing means for the yarn of the yarn supply bobbin is yarn sucking means provided on a yarn passage.

12. An apparatus as claimed in claim 11, wherein said sucking means includes a suction pipe having an opening opposing to said yarn passage, and a cover member for opening and closing said opening of said suction pipe.

13. An apparatus as claimed in claim 9, wherein said pre-set length of said yarn is controlled by a timer.

* * * * *